US005634872A

United States Patent [19]

Brown et al.

[11] Patent Number: 5,634,872

[45] **Date of Patent: *Jun. 3, 1997**

[54] APPARATUS FOR USE IN ENHANCING EXPLOSIVE LEG POWER

[75] Inventors: Barry S. Brown; Paul D. Reagan; Rosalie DiBrezzo; Inza L. Fort; Dean R. Gorman; Allen H. Hanna, all of Fayetteville, Ark.

[73] Assignee: Instructional Fitness Programs, Inc.

[ * ] Notice: The term of this patent shall not extend beyond the expiration date of Pat. No. 5,209,713.

[21] Appl. No.: 443,312

[22] Filed: May 17, 1995

Related U.S. Application Data

[63] Continuation of Ser. No. 53,439, Apr. 28, 1993, Pat. No. 5,417,631, which is a continuation of Ser. No. 542,828, Jun. 25, 1990, Pat. No. 5,209,713.

[51] Int. Cl.[6] ..... A63B 21/00

[52] U.S. Cl. ..... 473/430; 482/99; 482/92

[58] Field of Search ..... 273/1.5 A, 1.5 R; 482/92, 99, 112, 116, 84, 148, 87; 248/292.1, 402

[56] References Cited

U.S. PATENT DOCUMENTS

| | | | |
|---|---|---|---|
| 992,868 | 5/1911 | Gorman | 482/87 |
| 2,305,187 | 12/1942 | Neiden | 273/1.5 A |
| 2,697,603 | 12/1954 | Haines | 273/1.5 A |
| 2,939,705 | 6/1960 | McCall | 273/1.5 A |
| 2,986,395 | 5/1961 | Sheftel | 273/1.5 A |
| 3,012,781 | 12/1961 | Nelson | 275/1.5 A |
| 3,050,305 | 8/1962 | Bachand et al. | 273/1.5 A |
| 3,598,406 | 8/1971 | Robinson | 482/23 |
| 4,151,989 | 5/1979 | Dittrich | 273/1.5 A |
| 4,222,924 | 9/1980 | Boyd | 482/38 |
| 4,296,925 | 10/1981 | Alston | 273/1.5 A |
| 4,462,599 | 7/1984 | Brown | 273/411 |
| 4,522,394 | 6/1985 | Broussard | 273/105 R |
| 4,607,871 | 8/1986 | Bryson | 482/83 |

*Primary Examiner*—Jerome Donnelly
*Attorney, Agent, or Firm*—Ronald P. Kananen

[57] ABSTRACT

There is disclosed a method and apparatus for use in enhancing explosive leg power. Included is a supporting device for supporting an object which is selected to maximally motivate the individual seeking explosive leg power. Included is a device for allowing the individual to displace the object and for retracting the object upon release of the object.

6 Claims, 4 Drawing Sheets

APPARATUS FOR USE IN ENHANCING EXPLOSIVE LEG POWER

This application is a continuation of application Ser. No. 08/053,439 filed Apr. 28, 1993, now U.S. Pat. No. 5,417,631, which is a continuation of application Ser. No. 07/542,828 filed Jun. 25, 1990, now U.S. Pat. No. 5,209,713.

BACKGROUND OF THE INVENTION

The present invention relates generally to an improved method and apparatus for use in training individuals to improve their explosive leg power.

Explosive leg power is an integral aspect of many sports and, therefore, coaches are always looking for ways to improve this ability in every player. A variety of known devices have been utilized for purposes of enhancing the explosive leg power performance of athletes. These devices generally use mechanical overloading of muscles to enhance strength and power in athletes' legs. One drawback with such approaches, however, is that attempts to increase athletes' explosive leg power through mechanical muscle overloading do not take into account the speed of muscle shortening. This is because explosive leg power does not involve an isolated nerve or muscle group. Accordingly, mechanical muscle overloading is limited. Moreover, mechanical muscle overloading devices tend to put unwanted stress on other parts of a user's body.

Studies have, however, indicated that maximum muscle effort during training is difficult to achieve throughout a full range of muscle motion without motivation. That is, feedback is needed to keep the individual working at or near maximum capacity. One significant approach for enhancing the explosive leg power ability is through the utilization of an apparatus which is tied to a unique vertical jumping technique that does not rely on mechanical muscle overloading. Such an apparatus is described in an article entitled, "New Concepts in Exercise Physiology" by Barry Brown et al, appearing in *The Journal of Arkansas Medical Society*, (Vol. 74, No. 6, Nov. 1977). The apparatus is arranged to develop explosive leg power through coordinated adaption of the nervous and muscular systems. Essentially, the apparatus includes an upstanding support having extending generally horizontally therefrom a beam which mounts a switch for purposes of actuating a bell. Associated with the upstanding support is a scale which serves to measure the vertical distance the bell switch is from the floor. The article describes a training system in which a person is basically required to jump and touch the bell switch, which is related to a person's maximum jumping height, a predetermined number of consecutive times. The switch is generally set at the individual's maximum jumping height and such an apparatus is useful for purposes of developing explosive leg power explosiveness and includes feedback for insuring maximum effort. While this approach is successful in enhancing explosive leg power, there is, nevertheless, a continuing desire to improve thereupon. For example, it has been determined that the touch and sound feedback approach is less than entirely satisfactory in motivating an athlete to perform at or near maximum capacity for a sustained period of time.

None of the known prior approaches for enhancing explosive leg power effectively motivate the jumpers in a manner which enhances repeatability of desired repetitions and increases explosive leg power without mechanical muscle overloading.

SUMMARY OF THE INVENTION

According to the present invention, there is provided an improved method and apparatus for use in enhancing explosive leg power ability through specific, motivating jump training routines. Included in the apparatus is vertical support means and an object support means vertically movable relative to the vertical support means to various discrete heights. Included is means for displacing the object support means to a desired position and retaining the object support means relative to the vertical support means. An object is selected for motivational purposes to be interrelated to a sport or activity which most motivates the individual seeking improved explosive leg power. Provision is made for allowing a jumper to displace the object from an initial at-rest position which is at a preselected maximum jump height of the individual so as to simulate a success in a game situation; and for allowing the grasped object to be retracted to the initial at-rest position following release of the displaced object.

In an illustrated embodiment, the object selected is directly related to the sport or activity for which the individual seeks improved jumping.

In an illustrated embodiment, the means for allowing the object to be retracted after being pulled downwardly is automatically operable upon release of the object by the jumper.

In another illustrated embodiment, the displacing means is operable for mechanically vertically raising and lowering the object supporting means and thereby the object to various predetermined heights.

There is provided an improved method of enhancing vertical explosive leg power ability by selecting the object being grasped so as to maximally motivate the jumper and allowing the jumper to displace the object from an initial at-rest position, as well as to allow retraction of the displaced object to the initial at-rest position following release of the object.

Among the other objects and scope of further applicability of the present invention are the provision for an improved method and apparatus for enhancing explosive leg power: the provision for an improved method and apparatus which allows an individual to achieve a full range of motion at or near maximum capacity and which provides a highly motivational direct and instantaneous feedback upon achievement of the desired maximum jumping effort; the provision for an improved method and apparatus of the foregoing type which engages the individual's mind and emotions; the provision of an improved method and apparatus which utilizes an object which maximally motivates the person seeking improved explosive leg power; the improved method and apparatus which enhances motivation or by relating the object to the sport in which the individual is seeking improvement; the provision for an improved method and apparatus which allow ease of repetition of the feedback function; the provision for an improved method and apparatus which are safe and which can handle large numbers of people in short periods of time.

Still other objects and further scope of applicability of the present invention will become apparent from the detailed description to follow when taken in conjunction with the accompanying drawings.

DETAILED DESCRIPTION

The present invention is concerned with a physical conditioning method and apparatus for use in enhancing the explosive leg power of athletes or those desiring to become athletes.

Figure 1:
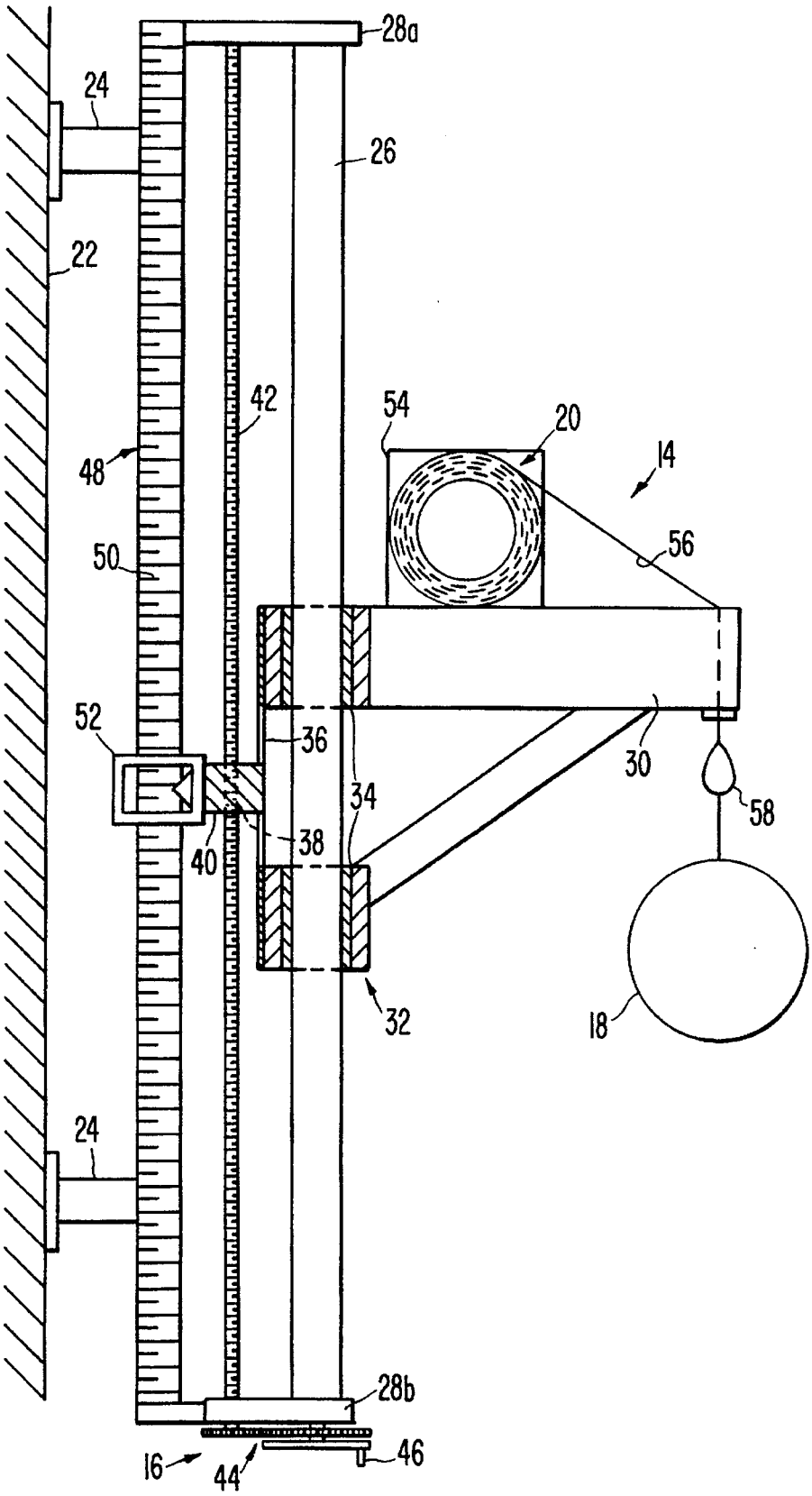
FIG. 1 is a diagrammatic view of one preferred embodiment of the present invention.

FIG. 1 represents one preferred embodiment of an explosive leg power training apparatus 10 of the present invention. Included in the explosive leg power training apparatus 10 is vertical supporting means or assembly 12, object supporting means or assembly 14, object support displacing and retaining means or assembly 16, ball 18, and an object pulling and retracting means or assembly 20.

The vertical supporting assembly 12 is shown attached to a wall 22 by means of suitable wall mounting brackets 24. Although not depicted, the present invention contemplates that the vertical support means 20 can be attached to a backboard and can be portable as well by being attached to a movable supporting frame.

The vertical supporting assembly 12 includes an upright support shaft 26 having attached at opposite ends thereof top and bottom plates 28*a*, 28*b*; respectively. The object supporting assembly 14 includes a generally horizontal canterlevered beam 30 being connected to and movable with a carriage assembly 32. The carriage assembly 32 includes a pair of axially spaced apart linear bearing assemblies 34 which are adapted to allow movement of the object support assembly 14 vertically relative to support shaft 26. The linear bearing assemblies 34 are connected by a plate 36 which has an internally threaded opening 38 formed in projection 40. The internally threaded opening 38 is arranged to cooperate with the object support displacement and retaining assembly 16. Specifically, the threaded opening 38 threadedly cooperates with a vertically mounted jack-screw shaft 42 which is journaled at opposite ends thereof in the top and bottom plates 28*a*, 28*b*. It will be appreciated that rotation of the screw shaft 42, in either direction, will result in corresponding vertical displacement of the carriage assembly 32.

With continued reference to the object support displacement and retaining assembly 16, it includes a gear train assembly 44 attached to the bottom end of the screw shaft 42 and a handwheel 46 which is rotatably mounted in the bottom plate 28*b*. The handwheel 46 is effective to rotate the screw shaft 42, through the gear train assembly in either rotational direction so as to effect the desired raising or lowering of the object supporting assembly 16 by desired degrees to preselected heights. Cessation of rotation will allow retention of the object support assembly in a desired position. Although this embodiment discloses a hand activated displacement mechanism, it will be appreciated that the present invention envisions that the object supporting driving assembly can include a reversible electric drive motor to raise and lower the object supporting assembly 16. While a screw shaft is utilized, it will be appreciated, of course, that several known equivalent vertical raising and lowering systems can be used instead. Also, a housing (not shown) would cover the gear train assembly.

Included in the apparatus 10 is an adjustable vertical scale assembly 48 having a scale 50 connected at opposite ends to the top and bottom plates 28*a*, 28*b* and a slidable scale pointer 52. The adjustable scale 48, if desired, can be replaced by any suitable electronic vertical distance measuring unit. The scale, of course, allows placing the ball at the desired height.

Reference is now made to the pulling and retracting assembly 20 of the present embodiment. The assembly 20 is defined by a commercially available spring reel device 54. In this embodiment, the spring reel device 54 is mounted on the beam 30 as depicted. Basically, the spring reel device 54 includes a cable 56 which extends from a spring reel housing and has its free end attached to an object attaching device, such as a holder 58. The canterlevered beam 30 is provided with an opening (not shown) through which the cable 56 is able to move vertically.

The ball 18 in this particular embodiment is a basketball which is suitably attached by a tether 60 to the holder 58. While this embodiment has disclosed the use of a basketball, it will be appreciated that a variety of other objects can be used instead. For instance, the object can be a baseball, football, soccer ball, gym rings or any other object which maximally motivates the person seeking improved explosive leg power. For example, the object can be directly related to the person's reason for training. This has been found to be a key motivational effect in engaging the person's mind, as well as makes it fun because it simulates success in a game situation. The spring reel device 54 allows the basketball to be pulled downwardly by a jumper grasping and pulling it. Upon release of the basketball 18, the spring reel device 54 retracts the cable 56 so that the hook 58 can return to its normal at-rest condition. In this regard, there is mounted on the cable 56 a stopper 62 which engages the beam 30 and stops upward movement of the holder 58 relative to the beam. The retractability aspect of the invention enhances reliable and quick repeatability of successive jumping attempts.

Figure 2:
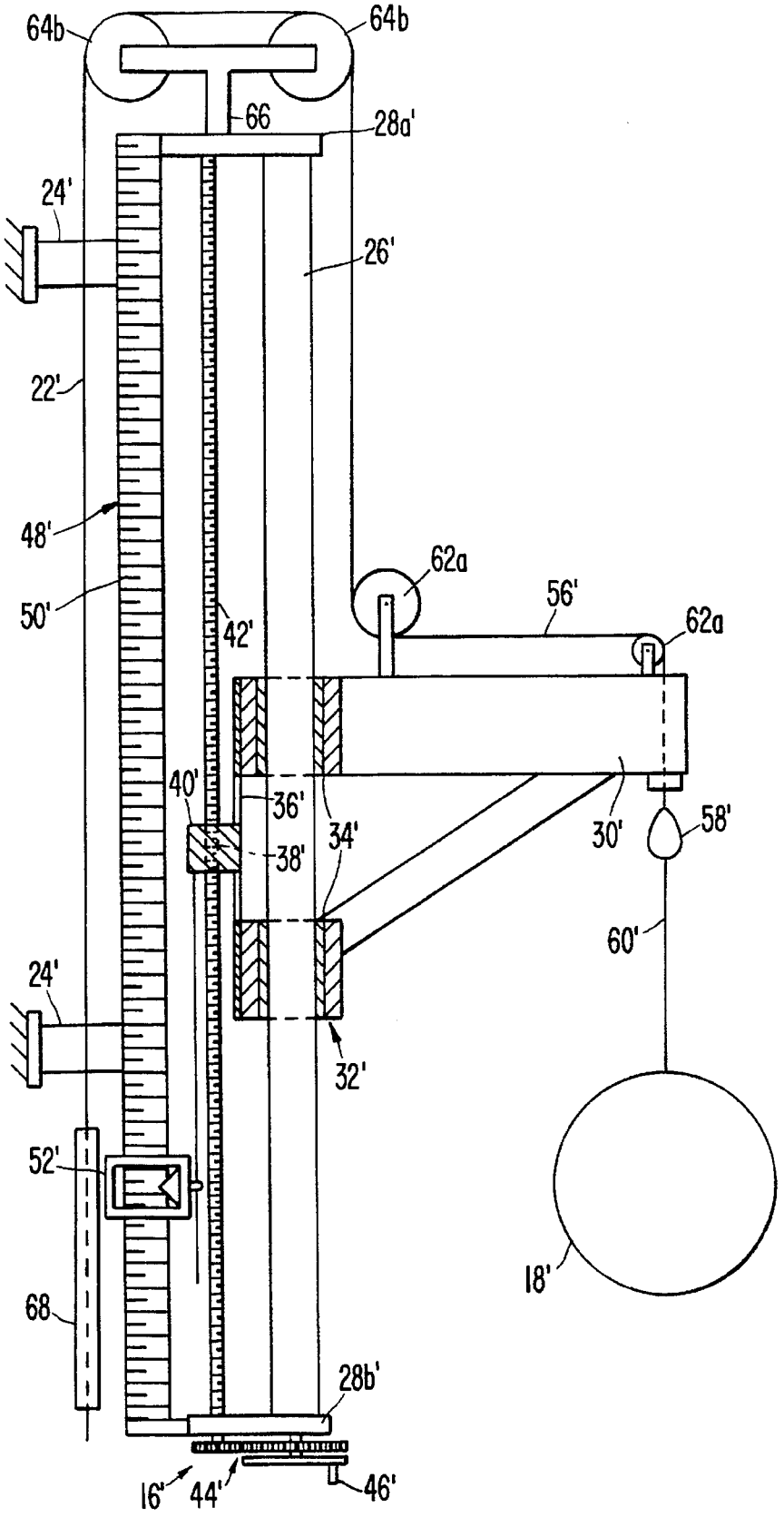
FIG. 2 is a diagrammatic view of another preferred embodiment of the present invention.

Reference is made to FIG. 2 for illustrating another preferred embodiment of the present invention. Structure of this embodiment which is similar to the previous embodiment will be indicated by the same reference numeral with, however, the addition of a prime marking. This embodiment differs from the foregoing insofar as the spring reel device 54 has been replaced by a counterweight and pulley system including two pairs of pulleys 64*a*, 64*b*. The pulleys 64*a* are mounted on the canterlevered beam 30', while the pulleys 64*b* are mounted on a suitable T-shaped support 66 attached to the top plate 28*a*'. The other end of the cable 56' is attached to a counterweight 68. The counterweight 68 will cause the basketball to return to its initial at-rest position upon the ball being released by the jumper. The counterweight 68 is arranged so as not to make contact with the brackets 24'.

Figure 3:
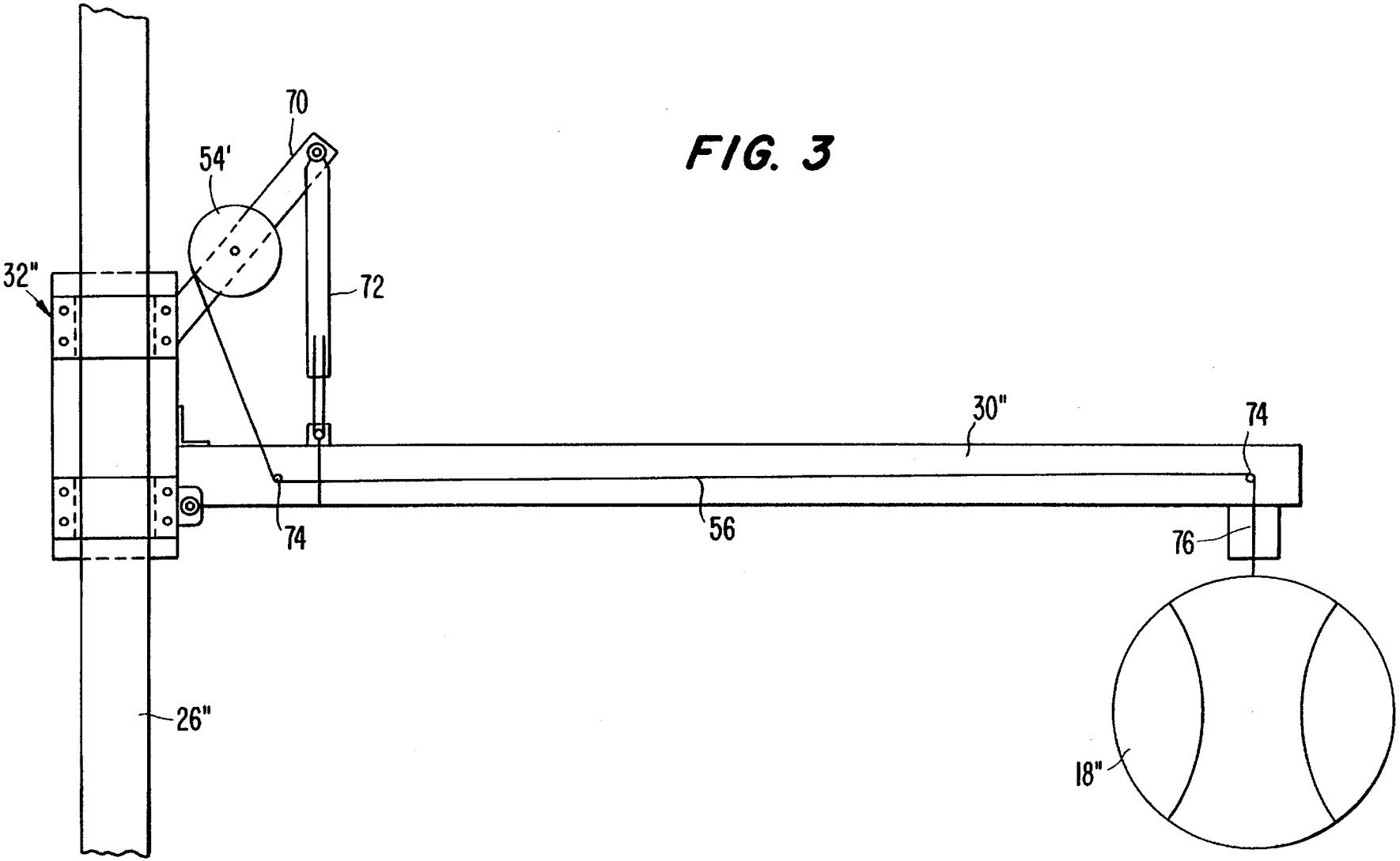
FIG. 3 is a diagrammatic view of still another preferred embodiment of the present invention.

FIG. 3 shows another preferred embodiment of the present invention in which the spring reel device 54" is mounted adjacent an end of the beam 30". The spring reel device 54" is mounted on a support 70. The support 70 has its free end attached to a vertical spring device 72 that is attached at the other end to the beam 30". The spring device 72 absorbs some of the downward force applied on the beam 30" during use. The support 70 is connected to and movable with the carriage 26". The cable 56" is trained around guide pins 74 and goes through a stopper 76 to the ball 18".

Figure 4:
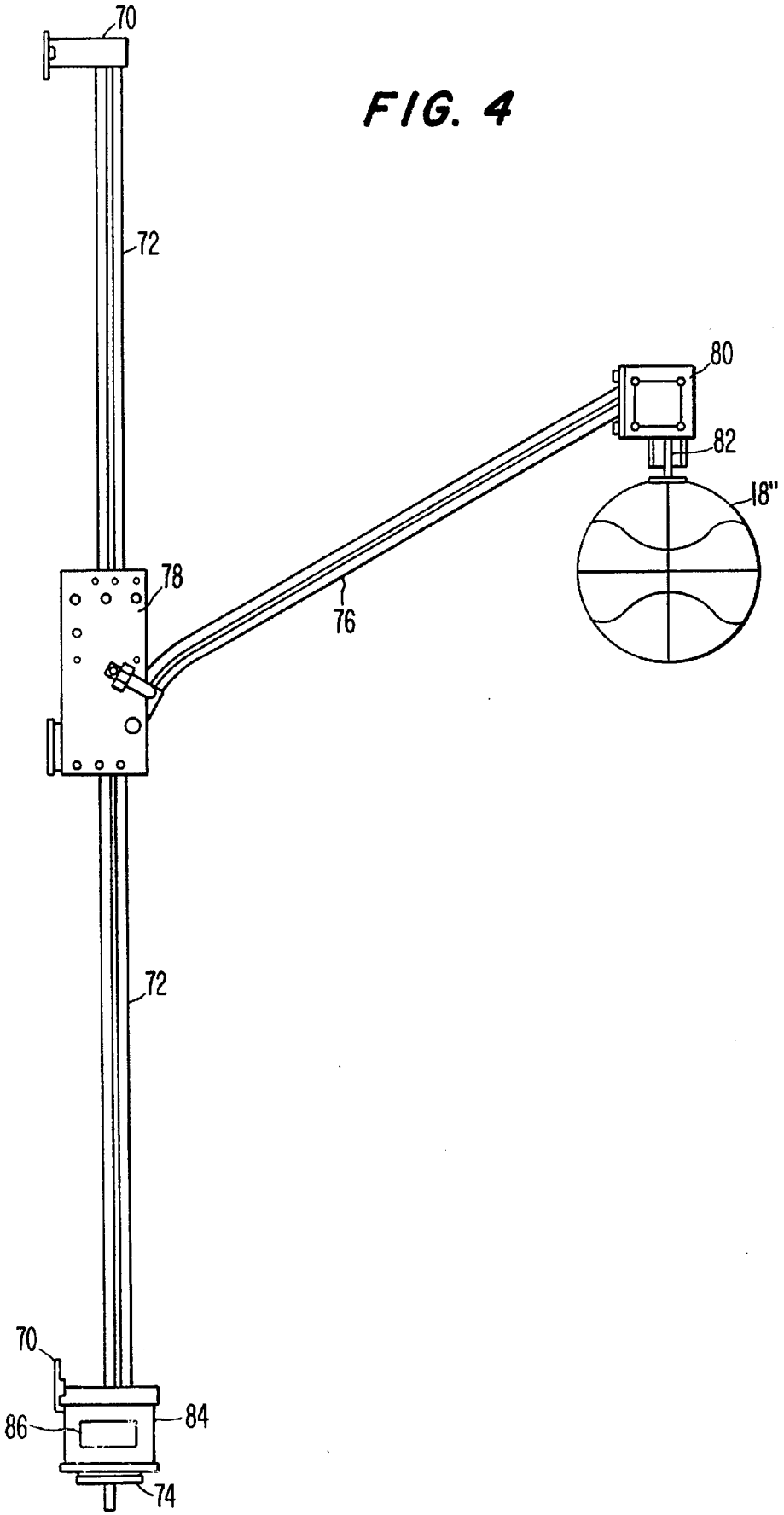
FIG. 4 is a diagrammatic view of still another preferred embodiment of the present invention.

FIG. 4 depicts another preferred embodiment of the present invention wherein there is a different mechanism for raising and lowering the ball 18". As shown, there is depicted mounting brackets 90 which rotatably support a smooth rotatable shaft 92. The shaft 92 is rotatably driven by a handwheel 94 which is connected to the bottom of the shaft 92. An inclined support arm 96 is attached at one end to a linear actuator 98 and at the other end to a spring reel device 80. The linear actuator 98 operates to convert the rotary motion of the shaft 94 to vertical movement of the support arm 96. The direction of vertical movement is a function of the direction of rotation. In a preferred embodiment, the linear actuator is a ROH'LIX® manufactured by Zero-Max, a unit of Barry Wright. Basically, the ROH'LIX® actuator may be described as a linear actuator similar to a ball nut except that it runs on a smooth, non-lubricated shaft. Referring back to the spring reel device 80, it includes a cable 82 which is secured to the ball 18'''. The spring reel device 80 and the ball 18''' function as in the previous embodiments. A distance measuring device 84 is attached to the shaft 92. The measuring device 84 includes an encoder device (not shown) that when operated, will provide a display or readout through a display mechanism 86 of the actual distance the center of the ball is from the floor. It will be appreciated that a variety of other techniques can be provided to provide a readout of the height the ball is raised or lowered to.

The operation of the present embodiments are believed self-evident from the above description. To supplement such understanding, it will be appreciated that a person seeking to improve their explosive leg power, in order to increase his vertical jumping ability must jump up and grasp the ball. Upon displacing the ball, the person will cause the ball to be pulled downwardly, thereby providing an immediate positive feedback so that the athlete realizes that he has achieved his goal. This enhances motivation since the athlete simulates success in the sport. The apparatus rewards successful jumps, and since the object can be grasped it provides instant reward and personal satisfaction. Upon release of the basketball, it will be automatically retracted to its at-rest initial position.

The apparatus enhances motivation of the athlete by simulating success in a game situation and thus improves carryover to the actual sport itself. Moreover, the apparatus when used in conjunction with a desired training technique, such as described in the earlier noted article increases explosive leg power as measured by validated tests accepted in professional literature for vertical jump (Vertical Jump), horizontal jump (5-Hop) and speed (Line Touch). The apparatus of this invention enhances the successful training technique described in said article and the details of that technique are incorporated herein by reference. Basically, a theoretical explanation for the greater improvements seen among groups using the present invention can be advanced from basic neurological concepts. Under normal life and/or non-threatening situations, muscle function is inhibited through chemical mediators at the synaptic junction. In order to maximize performance it is necessary to disinhibit these negative influences (i.e., R.O.N.I, release of neural inhibitions). This disinhibition can be promoted by motivational techniques which use a combination of internal and external foci, summation of muscular forces, and a goal oriented activity directed toward a single maximal explosive event. This is the basis of the training protocol when using the present invention. It should be noted that this apparatus is not limited by reference to such a technique and such technique does not, per se, form part of this invention.

The present invention contemplates, for example, electronic displays of the number of successful jumps, such as by a trip switch (not shown) being activated upon the ball being displaced a sufficient distance. The invention contemplates other electronic sensing and input devices being incorporated on the apparatus to be connected through appropriate devices to an internal or external computer which tracks numbers of successful attempts, jumps, athlete's weight and height for any jump.

According to the present invention, it will be recognized that certain changes may be made in the above described method and apparatus for use in training individuals to improve their explosive leg power without departing from the scope of the present invention herein involved. It is maintained that all matter contained in this description shall be interpreted as illustrative and not in a limiting sense.

We claim:

1. A training apparatus for use in enhancing explosive leg power of an individual, comprising:

an object support assembly vertically movable to a plurality of discrete vertical positions so as to be progressively moved to different jumping heights;

a base that supports and allows vertical movement of said object support assembly to said discrete vertical positions;

an object supported by said object support assembly, said object being adapted to be physically engaged and displaced by the individual while jumping, said object being directly related to the individual's reason for training so as to motivate the individual and simulate success in a game situation;

said object support assembly having a retraction assembly that allows an individual to displace said object from an initial at-rest position upon the individual successfully jumping and engaging said object and provides automatic retraction of said object to said initial at-rest position after being displaced so as to allow for repetitive jumps;

said retraction assembly being connected to and vertically movable with said object support assembly so as to enhance selective vertical adjustment of said object;

said object support assembly including a first portion which is vertically adjustable relative to said base, a beam extending from said first portion, and a tether or cable extending between said beam and said object to suspend said object freely from said beam.

2. An apparatus for use in enhancing explosive leg power of an individual, comprising:

an object support assembly vertically movable to a plurality of discrete vertical positions so as to accommodate different jumping heights;

a base that supports and allows displacement of said object support assembly vertically to the discrete positions;

an object adapted to be physically engaged and displaced by the individual while jumping;

said object support assembly having a retraction device that allows an individual to displace said object from an initial at-rest position upon the individual successfully jumping and displacing said object and provides active automatic mechanical retraction of said object to said initial at-rest position after being engaged by the individual so as to allow for repetitive jumps;

said retraction device being connected to and vertically movable with said object support assembly so as to enhance selective vertical adjustment of said object;

said object support assembly including a first portion which is vertically movable relative to said base and a beam extending from said first portion;

wherein said object is a ball.

3. An apparatus for use in enhancing explosive leg power of an individual, comprising:

an object support assembly vertically movable to a plurality of discrete vertical positions so as to be progressively moved to different jumping heights;

a base that supports and allows vertical movement of said object support assembly to said discrete vertical positions;

an object supported by said object support assembly, said object being adapted to be physically engaged and displaced by the individual while jumping;

said object support assembly having a retraction assembly that allows an individual to displace said object from an initial at-rest position upon the individual successfully jumping and engaging said object and provides automatic retraction of said object to said initial at-rest position after being displaced so as to allow for repetitive jumps;

said retraction assembly being connected to and vertically movable with said object support assembly so as to enhance selective vertical adjustment of said object;

said object support assembly including a first portion which is vertically adjustable relative to said base and a beam extending from said first portion;

wherein said object is a ball.

4. The training apparatus according to claim 1, wherein said object is a ball.

5. An apparatus for use in enhancing explosive leg power of an individual, comprising:

an object support assembly vertically movable to a plurality of discrete vertical positions so as to accommodate different jumping heights;

a base that supports and allows displacement of said object support assembly vertically to the discrete positions;

an object adapted to be physically engaged and displaced by the individual while jumping;

said object support assembly having a retraction device that allows an individual to displace said object from an initial at-rest position upon the individual successfully jumping and displacing said object and provides active automatic mechanical retraction of said object to said initial at-rest position after being engaged by the individual so as to allow for repetitive jumps;

said retraction device being connected to and vertically movable with said object support assembly so as to enhance selective vertical adjustment of said object;

said object support assembly including a first portion which is vertically movable relative to said base and a beam extending from said first portion;

further comprising a tether or cable extending between said beam and said object to suspend said object freely from said beam.

6. An apparatus for use in enhancing explosive leg power of an individual, comprising:

an object support assembly vertically movable to a plurality of discrete vertical positions so as to be progressively moved to different jumping heights;

a base that supports and allows vertical movement of said object support assembly to discrete vertical positions;

an object supported by said object support assembly, said object being adapted to be physically engaged and displaced by the individual while jumping;

said object support assembly having a retraction assembly that allows an individual to displace said object from an initial at-rest position upon the individual successfully jumping and engaging said object and provides automatic retraction of said object to said initial at-rest position after being displaced so as to allow for repetitive jumps;

said retraction assembly being connected to and vertically movable with said object support assembly so as to enhance selective vertical adjustment of said object;

said object support assembly including a first portion which is vertically adjustable relative to said base and a beam extending from said first portion;

further comprising a tether or cable extending between said beam and said object to suspend said object freely from said beam.

* * * * *